United States Patent [19]

Bielka

[11] Patent Number: 4,717,073

[45] Date of Patent: Jan. 5, 1988

[54] SPRAYER HEAD

[75] Inventor: Robert P. Bielka, Seattle, Wash.

[73] Assignee: The Boeing Company, Seattle, Wash.

[21] Appl. No.: 859,013

[22] Filed: May 2, 1986

[51] Int. Cl.[4] ..... B05B 15/02

[52] U.S. Cl. ..... 239/107; 239/519

[58] Field of Search ..... 234/107, 108, 109, 533.13, 234/533.14, 453, 533.1, 542, 504, 519, 524, 506, 452, 514

[56] References Cited

U.S. PATENT DOCUMENTS

| | | | |
|---|---|---|---|
| 2,188,354 | 1/1940 | Hudson | 239/533.13 X |
| 2,308,476 | 1/1943 | Gerrer | 239/533.13 X |
| 2,770,497 | 11/1956 | Filliung et al. . | |
| 2,770,498 | 11/1956 | Filliung et al. | 239/109 |
| 2,890,835 | 6/1959 | Filliung | 234/533.1 X |
| 2,936,958 | 5/1960 | Shames et al. | 239/109 |
| 2,954,170 | 9/1960 | Goyette et al. | 239/533.1 X |
| 3,013,729 | 12/1961 | McLean . | |
| 3,061,199 | 10/1962 | Billeter | 239/109 |
| 3,130,911 | 4/1964 | Billeter | 239/109 |
| 3,203,629 | 8/1965 | Goddard | 239/108 |
| 3,383,051 | 5/1968 | Fiorentino | 239/107 X |
| 3,807,633 | 4/1974 | Baker | 239/109 |
| 3,990,637 | 11/1976 | Nicholson | 239/108 |
| 4,190,204 | 2/1980 | Nicholson | 239/109 |
| 4,357,719 | 11/1982 | Badger et al. . | |

FOREIGN PATENT DOCUMENTS

| | | | |
|---|---|---|---|
| 1431364 | 1/1966 | France . | |
| 2548553 | 1/1985 | France | 239/107 |
| 580174 | 8/1958 | Italy | 239/108 |

*Primary Examiner*—Andres Kashnikow
*Assistant Examiner*—Kevin Patrick Weldon
*Attorney, Agent, or Firm*—Christensen, O'Connor, Johnson & Kindness

[57] ABSTRACT

A self-cleaning sprayer head having the capability to deliver a radially directed spray is disclosed. The sprayer head (10) includes a hollow, elongate casing (16), a flanged outlet end (28), and a plunger (42) mounted for sliding reciprocal movement within the casing. A spring (48) holds the plunger (42) in a retracted position. A flexible disc (38) connected to the outlet end of the casing defines an outlet gap (60). The disc (38) is connected to the plunger (42) for movement between a flush position, wherein the outlet gap (60) has a maximum width, and a spray position wherein the gap (60) has a minimum width. The disc (38) is configured to assume the flush position when the plunger (42) is retracted. When pressurized liquid is introduced into the casing (16), the plunger (42) moves in opposition to the spring (48) from its retracted position, through an intermediate position to a spray position. Simultaneously, the pressurized liquid passes through the ports (58) in the plunger and out through the gap. The disc (38) is moved by the plunger (42) from its flush position to its spray position when the plunger (42) moves from its intermediate position into its spray position. Since the disc (38) does not move from its flush position until the plunger (42) reaches its intermediate position, the pressurized liquid is ermitted to flow through the gap (60) when the gap is at its maximum width.

17 Claims, 5 Drawing Figures

Fig. 1.
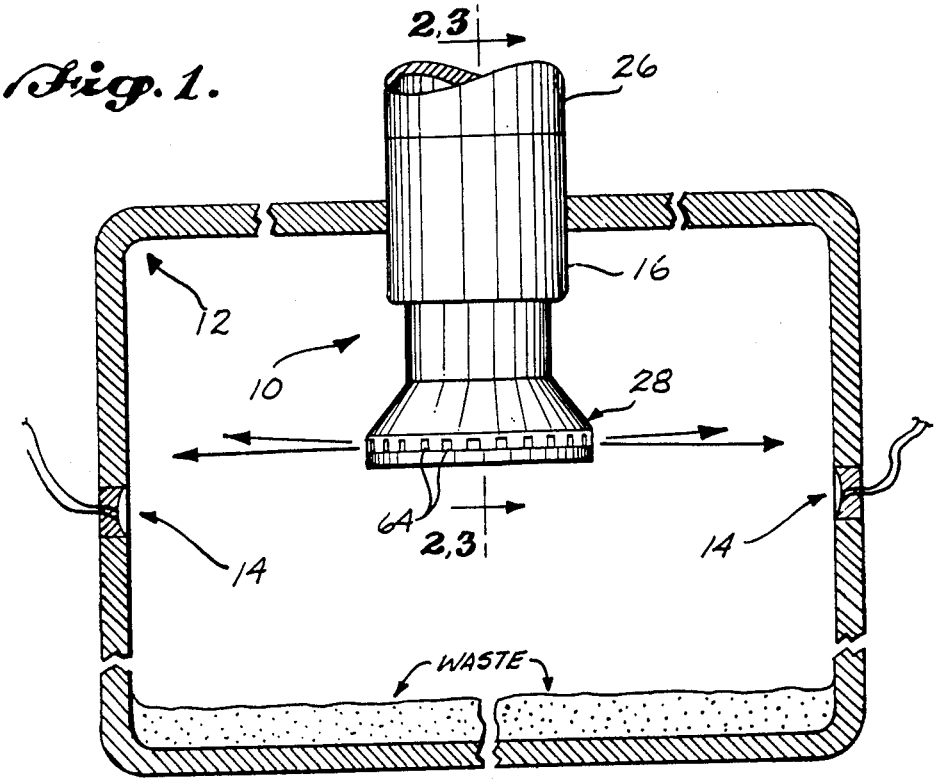
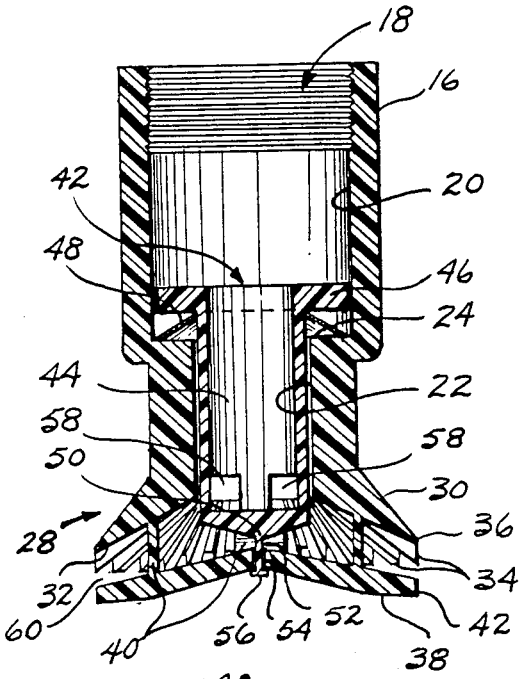
Fig. 2.
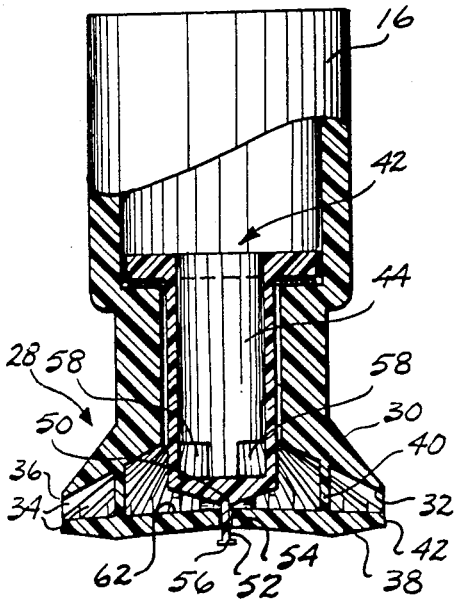
Fig. 4.

SPRAYER HEAD

TECHNICAL AREA

This invention relates to self-cleaning sprayer heads.

BACKGROUND OF THE INVENTION

Waste disposal systems in commercial aircraft typically employ vacuum-type flushing systems to forcibly transfer lavatory waste to a waste holding tank. The interior walls of the holding tank carry sensors that are activated when the level of waste rises to the maximum capacity of the tank. The sensors provide a signal to the flight crew that the tank is filled. The lavatory is then closed until the holding tank is emptied.

Often the waste will be drawn into the waste holding tank with such force that it is sprayed or splashed against the tank walls, thereby coating the sensors. The coated sensors are thus prematurely activated by the sprayed or splashed waste before the actual level of the waste reaches the sensors. This premature activation of the sensors results in needless and often inconvenient shutdown of the lavatory before the holding tank is actually filled.

One method of preventing the premature activation of the waste holding tank sensors is to apply a periodic spray of water against the sides of the tank to remove any accumulated matter on the sensors. This method involves the positioning of a sprayer head within the waste holding tank. The sprayer head is connected to a source of pressurized rinse water. The rinse water often carries foreign matter (such as rust particles) that tends to clog the sprayer head. It is therefore desirable to utilize sprayer heads with effective self-cleaning capabilities to eliminate the task of unclogging the somewhat inaccessible sprayer head by hand.

The prior art is replete with designs for self-cleaning shower or sprayer heads. The prior art devices, such as those shown in Filliung et al. (U.S. Pat. Nos. 2,770,497, Automatically Self-Cleaning Shower Heads) and Shames et al. (2,936,958, Self-Cleaning Shower Head), typically include a substantially cylindrical body that attaches to a water pipe that delivers water under pressure from a suitable source. The outlet end of the body has an inwardly projecting annular lip. The body houses a movable piston-like member that is mounted in the body by a spring or other elastic element. The piston-like member carries a disc on its outermost end. The space between the edge of the disc and the annular lip defines an outlet gap through which the water passes. The spring holds the disc away from the outlet end of the body when the water is shut off. When the water is supplied to the sprayer head, it forces the piston toward the outlet end of the body so that the gap between the disc and lip narrows. The narrow gap constricts the flow of water, thereby forming a spray. The self-cleaning aspect arises when the water is shut off and the piston and disc are retracted by the elastic member from the outlet end of the body. As the piston retracts, the outlet gap widens. Thus, any particles in the water that were restricted from passing through the gap during spraying are flushed through the now relatively wide gap by the water remaining in the sprayer head after the water is shut off.

Since the flushing action of prior art sprayer heads is accomplished by the water remaining in the sprayer head and adjacent section of pipe after the water supply is shut off, the flushing water provides no significant sprayer head cleaning force. Nor is any significant spray head cleaning force provided when the water is again turned on, since the water that is forced into the sprayer head by the source immediately moves the piston-like member to reduce the width of the gap. Therefore, with the prior art devices, flushing is never accomplished under conditions when the gap is at its widest and when the water flowing through the gap carries the flow energy imparted by the source. As a result, some of the particles, in particular those with widths roughly the same or slightly larger than the gap at its widest, remain in the sprayer head since they are never forced through the gap when the gap is at its widest by water having significant flow energy.

SUMMARY OF THE INVENTION

In accordance with this invention, a self-cleaning sprayer head is provided. The sprayer head includes a hollow elongate casing that is connectable at one end to a source of pressurized rinse water. The other, or outlet, end of the casing is outwardly flanged. A plunger is mounted for sliding reciprocal movement within the casing. The plunger has ports formed in it. When pressurized water is not being applied to the casing, the plunger is held in a retracted position by a spring mechanism. A flexible disc is connected to the outlet end of the casing. An outlet gap is defined by the space between the outermost edge of the flanged outlet end of the casing and the outermost edge of the disc. The disc is connected for movement between a flush position whereat the outlet gap has a maximum width, and a spray position whereat the gap has a minimum width. The disc is configured to assume its flush position when the plunger is in its retracted position.

When pressurized water is first applied to the casing, the plunger is forced to move in opposition to the spring mechanism from its retracted position, through an intermediate position, to a spray position. Simultaneously, the pressurized water passes through the ports in the plunger and out the gap. The disc is moved by the plunger from its flush position and to its spray position when the plunger moves from its intermediate position to its spray position. During the period of time the plunger moves from its retracted position to its intermediate position, the disc remains stationary. Since the disc does not move from its flush position until the plunger reaches its intermediate position, the gap remains wide. Consequently, the pressurized water that passes through the ports in the plunger during this period flows through the gap while at its maximum width.

The sprayer head also includes mechanisms for returning the disc to its flush position when the pressurized water is shut off and the plunger is moved by the spring mechanism from its spray position back to its retracted position.

As will be readily appreciated from the foregoing description, the sprayer head formed in accordance with the invention directs a flushing flow of pressurized water through a sprayer head gap while the gap is at its maximum width. As a result, particles trapped in the gap when the sprayer head gap was at its spray width are forcibly expelled.

In accordance with another aspect of the invention, the outermost edge of the disc and the outermost edge of the flanged outlet end of the casing are configured so that the spray emanating therefrom projects substantially radially outwardly from the longitudinal axis of the casing. Accordingly, a single sprayer head located in the center of a holding tank can be used to rinse substantially all of the interior surface area of the tank wall.

BRIEF DESCRIPTION OF THE DRAWINGS

The foregoing and other advantages and features of the present invention will be better understood from the following description of the preferred embodiment of the invention when considered in conjunction with the accompanying drawings wherein:

FIG. 1 is a side view of a preferred embodiment of a sprayer head formed in accordance with this invention shown positioned within a waste holding tank;

FIG. 2 is a cross-sectional view along line 2—2 of FIG. 1 showing the configuration of the sprayer head when no water is flowing through it;

FIG. 4 is a cross-sectional view along line 3—3 of FIG. 1 showing the configuration of the sprayer head when pressurized water is flowing through it.

DETAILED DESCRIPTION OF THE PREFERRED EMBODIMENT

FIG. 1 shows a sprayer head 10 formed in accordance with this invention in its presently contemplated environment. Specifically, the sprayer head 10 is attached to the top of an aircraft's waste holding tank 12. The tank receives waste from an aircraft lavatory. The waste is drawn into the tank by a vacuum system (not shown). A number of waste level sensors 14 are mounted in the interior of the sidewalls of the tank 12. The sensors 14 respond to contact by the waste in the tank to provide a signal to a control system that the tank is filled.

Often waste is drawn into the waste holding tank 12 with such force that it is sprayed or splashed against the tank sidewalls and coats the sensors 14. Thus, the coated sensors are activated before the actual level of waste reaches the sensors. Premature activation of the sensors results in needless and often inconvenient automatic shutdown of the lavatory due to the erroneous signal to the control system that the holding tank is filled. The sprayer head 10 formed in accordance with this invention avoids this result by spraying rinse water against the sides of the tank 12 and removing any waste that may have splashed on the sensors.

The waste holding tank 12 (hence, the sprayer head 10) is normally located in a somewhat inaccessible location on the aircraft. Usually only a bottom drainage valve in the waste holding tank is readily accessible by maintenance personnel for purposes of draining a full tank. It is important therefore that the sprayer head be designed to avoid clogging by including a mechanism for the effective flushing of the sprayer head of any foreign matter that might clog it. As will become clear upon reading this description, the sprayer head 10 incorporates such a self-cleaning mechanism. Furthermore, since weight considerations always make it desirable to eliminate any unnecessary structures aboard an aircraft, rather than providing several unidirectional sprayer heads to rinse the sidewalls of the waste holding tank, a single sprayer head formed in accordance with this invention directs rinsing spray against all of the interior sidewalls of the holding tank 12. More particularly, as shown by the arrows in FIG. 1, the sprayer head is configured so that a radially directed spray of water emanates therefrom in all directions and rinses all of the interior sidewalls of the tank.

Figure 3:
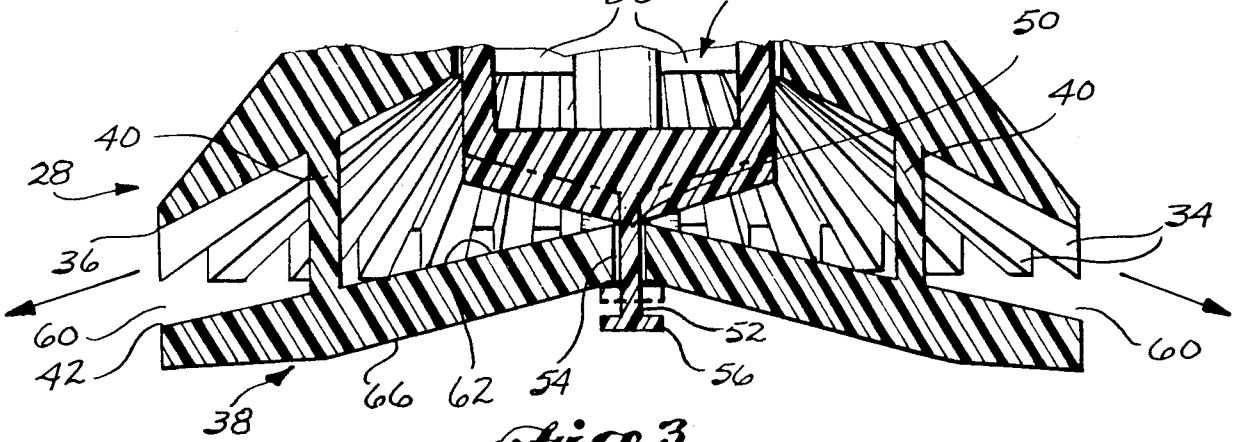
FIG. 3 is an enlarged view of a part of FIG. 2.

Referring to FIGS. 1, 2 and 3, the sprayer head 10 comprises a substantially cylindrical elongate casing 16. Preferably, the casing is formed of lightweight corrosion-resistant material such as polypropylene. The casing has a stepped bore 18 extending therethrough. The bore 18 includes an upper bore section 20 and a lower bore section 22. The upper bore section 20 has a diameter greater than the diameter of the lower bore section 22. An internal shoulder 24 is formed between the two bore sections. At the upper end of the casing 16 the bore 18 is threaded to facilitate connection of the casing to a water pipe 26. The pipe 26 delivers pressurized water from a suitable source to the sprayer head. The other, or outlet end 28, of the casing carries an integrally formed outwardly projecting flange 30. The bottom surface 32 of the flange is downwardly and outwardly inclined relative to the longitudinal axis of the casing. A plurality of ridges 34 are formed on the bottom surface 32 of the flange 30. The ridges 34 are substantially rectangular in cross section and extend radially outwardly along the bottom surface 32 of the flange from where that surface meets the lower bore section 22 to the outermost edge 36 of the flange. The ridges 34 are tapered. The maximum height (as measured outwardly from the bottom surface) of the ridges occurs at the outermost edge 36 of the flange. The ridges taper inwardly therefrom, ending where the bottom surface 32 of the flange meets the end of the lower bore section 22.

A flexible disc 38 is located at the outlet end 28 of the casing. The disc is connected to the casing by four struts 40 that are evenly spaced around the outlet end of the casing. Specifically, each strut 40 extends downwardly from the midpoint of the bottom surface 32 of the flange 30 and is connected to the disc 38 at a point between the center of the disc and its outermost edge 42. The struts 40 hold the disc spaced from the bottom surface 32 of the flange 30.

While, preferably, the casing 16, disc 38 and struts 40 are all integrally formed by a process such as plastic injection molding, it is to be understood that various equivalent means of connecting a separately formed casing and disc could be used, if desired. For example, the struts 40 could be unitary articles having flexible T-shaped ends that snap fit into correspondingly-shaped recesses formed in both the flange and disc.

A plunger 42 is mounted for sliding reciprocal movement within the casing 16. Specifically, the plunger 42 is a substantially cylindrical element having an internal cavity 44. The plunger 42 has an outwardly flanged top portion 46. The flanged top portion 46 of the plunger resides within the upper bore section 20 of the casing. The flanged top portion has a diameter approximately equal to the upper bore section diameter.

The flanged top portion 46 of the plunger rests on a compression spring 48 that surrounds the plunger beneath the flanged top portion. One example of a suitable spring is commonly known as a Belleville-type spring. The spring 48 is seated upon the interior shoulder 24 of the casing.

The lower end of the plunger abruptly tapers to a center point 50. An integrally formed pin 52 extends downwardly from the lower center point 50 of the plunger. The pin passes through a central aperture 54 formed in the disc 38. The pin has a head 56 formed on its outermost end. The diameter of the head 56 is greater than that of the aperture 54.

Four circumferentially spaced outlet ports 58 are formed in the wall of the plunger 42 at the lower end of the cavity 44. The ports 58 direct the flow of pressurized water from the pipe out of the sprayer head as described in more detail below.

Turning now to the operation of the sprayer head 10, the movable parts of the sprayer head assume the arrangement shown in FIG. 2 when no pressurized water is supplied to the casing. Specifically, the spring 48 is substantially uncompressed and supports the plunger 42 in a retracted position within the casing. In this position, the flanged top portion 46 of the plunger is held upwardly from the casing's internal shoulder 24. Furthermore, the flexible disc 38 is held inwardly bowed by the head 56 of pin 52. The inward bowing of the flexible disc causes the disc to rotate about the struts resulting in the outermost edge of the disc being held away from the outermost edge 36 of the flange 30 of the casing. This is the sprayer head flush configuration.

When pressurized water is introduced into the bore 18 of the casing 16, it passes into the central cavity 44 of the plunger 42 and out through the ports 58 into the space between the disc 38 and the flange 30 of the casing. The water exits through the gap 60 formed between the outermost edge 42 of the disc and the outermost edge 36 of the flange. As water pressure builds within the casing, the plunger 42 is forced downwardly in oppostion to the retraction force created by the spring 48. As shown in FIG. 3, as the spring force is overcome, the plunger initially travels downwardly from its retracted position (shown in dotted lines in FIG. 3) to an intermediate position (shown in solid line) whereat the point 50 of the plunger is immediately adjacent to the center of the top surface 62 of the disc. The distance traveled is a lost motion distance. Tht is, the length of the plunger 42 is such that it moves out of the retracted position and through the lost motion distance to the intermediate position without contacting the disc 38. The pin 52 slides through the central aperture 54 of the disc as the plunger moves from its retracted to its intermediate position. During this movement, the water, which is constantly increasing in force as evidenced by the corresponding movement of the plunger against the compression spring, flows with high velocity through the ports 58 and out the gap 60. Because the disc is bowed inwardly, the gap is at its widest.

As will be appreciated, flow of pressurized water through the gap 60 when the gap is widest provides a thorough flushing action that removes particles trapped in the space between the casing and the disc 38 when the gap is narrower. As next described, the gap is narrower during spraying. Thus, the flushing action removes particles that were trapped during the previous spraying operation.

Figure 5:
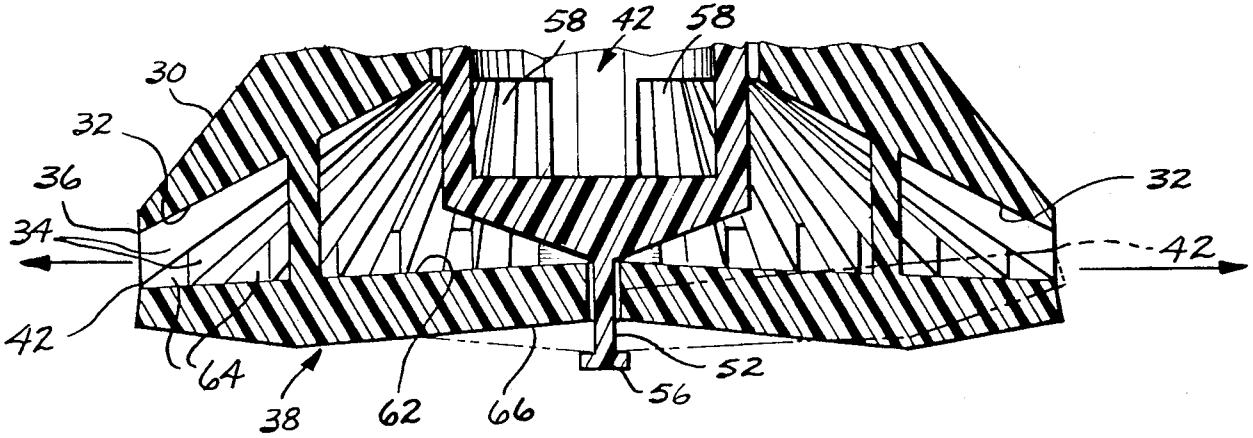
FIG. 5 is an enlarged view of a part of FIG. 4.

As the plunger continues its downward movement, it moves from its intermediate position to a spray position (FIGS. 4 and 5). The spray position is reached, and the plunger's downward movement stops, when the flanged top portion 46 of the plunger compresses the spring 48 against the internal shoulder 24 of the casing. As the plunger moves from the intermediate position to the spray position, it pushes the center of the disc 38 outwardly, reducing the degree of bow in the disc. As a result, the outermost edge 42 of the disc rotates inwardly, about the struts 40. Thus, the gap 60 narrows and constricts the flow of water. In this way, a high-velocity spray is created. Preferably, the sprayer head is configured so that when the plunger is in the spray position the outermost edge 42 of the disc is in contact with the outermost edges of the ridges 34 located on the bottom surface 32 of the flange 30. Accordingly, the bottom surface of the flange 30, the top surface of the disc 38 and the spaces between the ridges define a plurality of circumferentially spaced spray orifices 64. Since the overall diameter of the disc 38 and the diameter of the casing flange 30 are substantially equal when measured perpendicular to the longitudinal axis of the casing, the orifices 64 are oriented to direct the flow of water radially outwardly in all directions, substantially perpendicular to the longitudinal axis of the casing.

When the supply of pressurized water is shut off, the spring 48 moves the plunger from its spray position back to its retracted position. Before the plunger completely returns to the retracted position, the head 56 of the pin 52 contacts the outer surface 66 of the disc. Continued movement of the head results in the disc being pulled by the plunger back into its bowed configuration. As noted earlier, when the disc 38 is inwardly bowed, its outermost edge 42 is furthest away from the outermost edge 36 of the flange 30 and the gap 60 is at its widest.

It is to be understood that various changes, substitutions of equivalents and other alterations can be made without departing from the spirit and scope of the invention. For example, as another alternative method of constructing the above-described sprayer head, it is contemplated that the disc 38 could be formed of elastic material having a relaxed shape corresponding to the bowed configuration described earlier. Accordingly, the disc will be elastically deformed when the plunger 42 pushes it outwardly as the plunger moves into the spray position. With this structure, it is not necessary to attach a headed pin 52 to the plunger in order to return the disc to its bowed configuration since the elastic forces generated in the deformed disc will cause it to return to that position when the plunger moves away from the disc and returns to its retracted position.

As another alternative embodiment, it is possible to provide a radially continuous spray by omitting the ridges 34 in the bottom surface of the flange in the casing. In this instance, it is preferable to incorporate the headed pin 52 described earlier. As shown in dotted lines of FIG. 5, the headed pin is necessary in this alternative embodiment to keep the disc from bowing outwardly too far at its center when pressurized water flows through the device. More particularly, if the pressure of the water acting on the central region of the inner surface 62 of the disc is very high, the disc will bow outwardly to such an extent that the outermost edge 42 of the disc will move close to the outermost edge 36 of the flange (since the ridges are not there to stop it), resulting in a severely restricted and ineffective spray. However, with the headed pin 52 attached to the plunger, the outward movement of the disc's center (hence, the inward movement of its edge) is restrained. Thus, the desired flow constriction at the gap 60 is provided.

The embodiments of the invention in which an exclusive property or privilege is claimed are defined as follows:

1. A sprayer head comprising:

(a) a hollow elongate casing connectable at one end to a source of pressurized liquid, the other end of the casing being an outlet end;

(b) a plunger mounted for sliding reciprocal movement within the casing, the plunger having ports formed therein;

(c) elastic means for urging the plunger into a first position within the casing when no pressurized liquid is being introduced into the casing, the plunger being configured and arranged so that when pressurized liquid is introduced into the casing, the plunger moves in opposition to the urging of the elastic means into a second position; and (d) a flexible disc connected to the outlet end of the casing to define an outlet gap between the outlet end of the casing and the outermost edge of the disc, the disc being connected for movement between a flush position wherein the gap has a maximum width and a spray position wherein the gap has a minimum width, the disc being configured and arranged to be moved out of the flush position and into the spray position by the plunger when the plunger moves into its second position, the ports and the plunger being configured to direct the introduced pressurized liquid through the gap, the plunger and disc being arranged so that the plunger moves a portion of the distance between the first and second positions before the disc is moved out of the flush position.

2. The sprayer head of claim 1, including lost motion connection means for connecting the plunger to the disc.

3. The sprayer head of claim 2, wherein the disc extends across the outside of the outlet end of the casing and is connected thereto by a plurality of strut elements, and wherein the outermost ends of the disc are moved toward the outlet end of the casing when the disc is moved from its flush position to its spray position.

4. The sprayer head of claim 3, wherein the outlet end of the casing is outwardly flanged and wherein the outermost edge of the flanged outlet end of the casing and the outermost edge of the disc define the gap.

5. The sprayer head of claim 4, wherein the outermost edge of the disc and the outermost edge of the flanged outlet end of the casing are substantially radially equidistant from the longitudinal axis of the casing.

6. The sprayer head of claim 5, further including a plurality of spaced-apart ridges formed in the flanged outlet end of the casing, the ridges extending outwardly to the outermost edge of the flanged outlet end of the casing, the portion of the ridges at the outermost edge of the flanged outlet end extending toward the disc for a distance substantially equal to the minimum width of the gap, thereby dividing the gap into a plurality of spaced-apart orifices when the disc is in the spray position.

7. The sprayer head of claim 2, wherein the lost motion connection means comprises a pin attached to and extending from the plunger toward the disc, the disc having a central aperture through which the pin passes, the pin having a head on its outermost end, the diameter of the head being greater than the diameter of the aperture.

8. The sprayer head of claim 1, wherein the disc is formed of substantially elastic material, the disc being in an undeformed state when it is in the flush position, the disc being deformed by the plunger when the plunger moves into its second position, and wherein the elastic force generated within the deformed disc returns the disc to its flush position when the plunger moves from its second position to its first position.

9. The sprayer head of claim 8, wherein the outlet end of the casing is outwardly flanged, and wherein the outermost edge of the flanged outlet edge of the casing and the outermost edge of the disc define the gap.

10. The sprayer head of claim 9, wherein the outermost edge of the disc and the outermost edge of the flanged outlet end of the casing are substantially radially equidistant from the longitudinal axis of the casing.

11. The sprayer head of claim 10, further including the plurality of spaced-apart ridges formed in the flanged outlet end of the casing, the ridges extending outwardly to the outermost edge of the flanged outlet end of the casing, the portion of the ridges at the outermost edge of the flanged outlet end extending toward the disc for a distance substantially equal to the minimum width of the gap thereby dividing the gap into a plurality of spaced-apart orifices when the disc is in the spray position.

12. A self-cleaning sprayer head comprising:

(a) a casing having an inlet end, an outlet end, and a bore extending between the inlet and outlet ends, the inlet end being connectable to a source of pressurized liquid;

(b) a flexible disc connected to, but spaced from, the casing proximal to the outlet end thereof, the disc being normally positioned so that its outermost edge and the outermost end of the casing define a gap;

(c) a plunger mounted for sliding reciprocal movement within the bore of the casing, the plunger being configured to slide between a first position wherein the plunger is located away from the disc, and a second position wherein the plunger is in contact with the disc, the disc being configured and arranged so that when the plunger is in the second position, the disc is moved out of its normal position to a spray position wherein the size of the gap is reduced relative to its size when the disc is in the normal positon, the plunger being configured to move from the first to the second position in response to the pressurized liquid when the liquid flows into the bore of the casing, the plunger having ports to direct the liquid from the bore of the casing into the space between the disc and the casing and out through the gap, the plunger and ports being configured and arranged so that the pressurized liquid is directed out of the gap before the disc is moved by the plunger out of its normal position; and (d) return means for returning the plunger to the first position when the flow of pressurized liquid into the bore is shut off.

13. The sprayer head of claim 12, wherein the disc is formed of substantially elastic material, the disc being in an underformed state when in the normal position, the disc being deformed when moved by the plunger into its second position, and wherein the elastic force generated within the deformed disc returns the disc to its normal position when the flow of pressurized liquid is shut off.

14. The sprayer head of claim 13, wherein the outlet end of the casing is outwardly flanged, the outermost edge of the flanged outlet end of the casing and the outermost end of the disc defining the outlet gap.

15. The sprayer head of claim 14, wherein the outermost edge of the disc and the outermost edge of the flanged outlet end of the casing are substantially radially equidistant from the longitudinal axis of the casing.

16. The sprayer head of claim 12, wherein the return means comprises a spring mounted in the casing for urging the plunger toward the first position and lost motion connection means connecting the plunger and disc for linking the motion of the plunger to the disc as the plunger returns to the first position.

17. The sprayer head of claim 16, wherein the lost motion connection means comprises a pin attached to and extending from the plunger toward the disc and a central aperture in the disc through which the pin passes, said pin having a head on its outermost end, the diameter of the head being greater than the diameter of the aperture.

* * * * *